United States Patent [19]

Larsson et al.

[11] 4,078,408

[45] Mar. 14, 1978

[54] METHOD OF HYDROSTATIC EXTRUSION FOR HOLDING A BILLET DURING INSERTION INTO A PRESSURE CHAMBER

[75] Inventors: Hans-Gunnar Larsson; Erik Westman, both of Vasteras, Sweden

[73] Assignee: ASEA Aktiebolag, Vasteras, Sweden

[21] Appl. No.: 734,505

[22] Filed: Oct. 21, 1976

[30] Foreign Application Priority Data

Oct. 23, 1975 Sweden ..... 7511865

[51] Int. Cl.[2] ..... B21C 33/00; B21C 23/00

[52] U.S. Cl. ..... 72/60; 72/270; 72/DIG. 31

[58] Field of Search ..... 72/60, 253, 270, DIG. 31

[56] References Cited

U.S. PATENT DOCUMENTS 3,531,965 10/1970 Nilsson ..... 72/60
3,620,059 11/1971 Nilsson ..... 72/60
3,751,958 8/1973 Nilsson et al. ..... 72/60

*Primary Examiner*—C.W. Lanham
*Assistant Examiner*—D. M. Gurley
*Attorney, Agent, or Firm*—Watson, Cole, Grindle & Watson

[57] ABSTRACT

A holding force for retaining a billet and die against a die support is obtained by forming a pressure drop in the pressure medium flow in a gap between the billet and a surrounding constructional element inside the pressure chamber. The gap may be formed by the outer surface of the billet and the inner surface of the high pressure chamber. The gap may also be formed between the outer surface of the billet and the inner surface of a spacing tube mounted within the pressure chamber. The spacing tube is constructed with a portion having a smaller diameter than the remainder of the spacing tube to provide a gap to achieve a sufficient pressure drop for retaining the billet and die against the die support.

7 Claims, 2 Drawing Figures

METHOD OF HYDROSTATIC EXTRUSION FOR HOLDING A BILLET DURING INSERTION INTO A PRESSURE CHAMBER

BACKGROUND OF THE INVENTION

The present invention relates to method and apparatus for holding a billet while closing a pressure chamber during hydrostatic extrusion. The method can be used in a press where, upon inserting the billet, the pressure chamber during closing is supplied with a pressure medium at the end where a pressure-generating piston is inserted to generate the necessary extrusion pressure. The supplied pressure medium achieves a holding force which holds the billet and a die pressed against a die support, thus fixing the billet and the die in a definite, desired position during the closing of the pressure chamber.

In a known press of the kind mentioned, there is a billet-holding piston with valve members which, when there is a certain pressure difference between the two sides of the piston, allows pressure medium to pass from a space on one side of the piston to a space on its other side. When the movement of the piston is prevented by contact with an inserted billet, the pressure increases in the space on one side of the piston until the valve member is opened so that pressure medium passes the piston. The difference in pressure results in a force which may be utilized to hold a billet and a die during the closing of the pressure chamber. Such a press is described in detail in U.S. Pat. No. 3,531,965.

SUMMARY OF THE INVENTION

According to the present invention, the holding force is achieved by a pressure drop in the pressure medium flow in a gap between the billet and a surrounding constructional element inside the pressure chamber. In a press with a conical sealing surface between an inner tube in the high-pressure cylinder of the pressure chamber and the die or die support, the gap may be formed by the outer surface of the billet and the inner surface of the high-pressure cylinder. In a press with sealing rings inside the high-pressure cylinder, the gap may be formed between the outer surface of the billet and the inner surface of a spacing tube between the seals at the two ends of the cylinder. Suitably this spacing tube at the die end is constructed with a portion having a smaller diameter than the rest of the tube so that a gap for achieving a sufficient pressure drop and simultaneously sufficient play between the billet and sealing rings can be obtained. At the end where the pressure-generating piston is pushed in, the spacing tube must have a greater diameter than the pressure-generating piston.

It is also possible to provide a billet with a ring or disc which is applied at the inner part of the billet. The gap is then formed between this element applied on the billet and an inner surface in the pressure chamber.

A billet-holding piston requires a certain part of the length of the pressure chamber. The piston influences the length of the pressure chamber. Because the invention eliminates the need for the billet-holding piston, a longer billet can be used for a certain, given length of the cylinder. Additionally, the elimination of the movable piston with its attendant valves involves an advantage from the point of view of servicing, since the piston is relatively difficult to reach for inspection and service.

BRIEF DESCRIPTION OF THE FIGURES

The invention is described in greater detail with reference to the accompanying Figures wherein.

In the Figures, the same numerals are used to designate the same elements.

Figure 1:
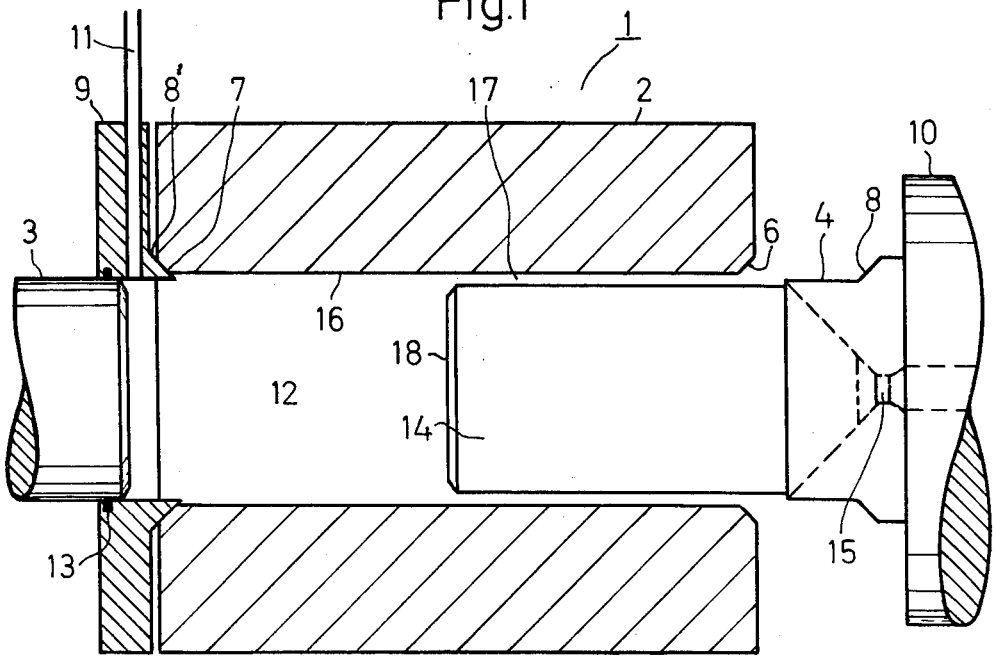
FIG. 1 shows a pressure chamber with conical seals.

In the embodiment according to FIG. 1, cylinder 2 includes conical sealing surfaces 6 and 7 designed to cooperate with conical sealing surface 8 of die 4 and with conical sealing surface 8′ of end plate 9, respectively. Die 4 rests on die support 10. In plate 9 there is channel 11 through which space 12 can be supplied with a pressure medium through a pressure medium source, not shown. Outside the orifice of channel 11 there is seal 13. In the pressure chamber there is billet 14 which, in die 4, is formed into a product whose cross-section is determined by die opening 15. Between billet 14 and inner wall 16 of cylinder 2 there is formed gap 17. Pressure medium which is supplied to space 12 through channel 11 must leave space 12 through gap 17. By supplying an amount of pressure medium per unit of time which is suitably adjusted to the width of gap 17, a pressure drop of such a magnitude can be obtained in gap 17 that the pressure against end surface 18 of billet 14 causes that axial force which is required for securing core 14 and die 4. The size of gap 17 should be smaller than 1 mm in order to obtain the required pressure in space 12 with the amount of pressure medium that can possibly be supplied in practice per unit of time. In cylinder 2, with a conical sealing surface 6 it is possible to have a small play and thus a small gap 17 between the billet and cylinder since the high-pressure chamber has no easily damaged sealing rings.

Figure 2:
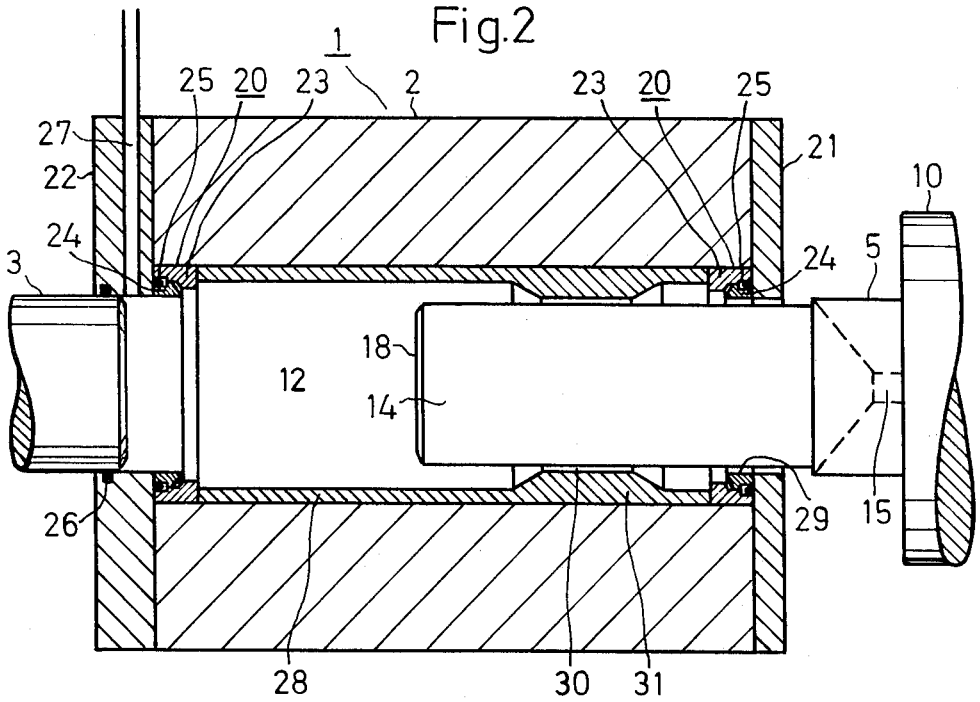
FIG. 2 illustrates a pressure chamber with seals having two metallic sealing rings arranged inside the high-pressure cylinder.

In the embodiment according to FIG. 2, the high-pressure chamber is provided at both ends with seals 20 and end plates 21 and 22 which also serve as seal holders. The seals contain first sealing ring 23, the outer surface of which seals against the inner surface of cylinder 2, and second sealing ring 24, the inner surface of which seals against the outer surface of pressure-generating punch 3 and against the outer surface of die 5, respectively. The outer end surfaces of rings 23, 24 bear against plates 21 and 22 in a sealing manner. In annular slots, formed by sealing rings 23 and 24 and plates 21 and 22, respectively, there is elastomeric sealing ring 25. In plate 22 there is outer seal 26 which seals between plate 22 and pressure-generating punch 3, and channel 27 opening out inside seal 26. Space 12 can be supplied with pressure medium through channel 27 from a pressure medium source, not shown, when the pressure-generating punch is in the position shown in the Figure. Between seals 20 there is spacing tube 28. Because sealing ring 24 is sensitive to mechanical influence from billet 14, there must be such a play 29 between ring 24 and billet 14 that there is no risk of the billet and the ring coming into contact while inserting the billet. In order to obtain a sufficiently small gap 30 in view of the generation of the necessary pressure drop, one portion 31 of spacing tube 28 at the die end is formed with a smaller diameter than the other part of the tube. Portion 31 must not have such an extension that pressure-generating punch 3 might come into contact with it. Gap 30 generates such a pressure drop when pressure medium is supplied to space 12 that the pressure against end surface 18 of billet 14 provides the required axial holding force.

We claim:

1. A method for generating a holding force to retain a billet and die pressed against a die supported in a pressure chamber in a hydrostatic extrusion press comprising the steps of:

supplying a pressure medium in the space at the end of the pressure chamber where the pressure-generating piston is inserted during the insertion of a billet therein while closing the pressure chamber; and creating the only holding force for the billet through the pressure drop of the pressure medium flow in a gap between the billet and a surrounding constructional element in the pressure chamber, said gap having a radial dimension of less than 1mm.

2. A method according to claim 1 wherein the pressure drop is formed in a gap between the outer surface of the billet and the inner surface of the high pressure cylinder of the pressure chamber.

3. A method according to claim 1 wherein the pressure drop is created in a gap formed between the billet and a spacing tube contained between seals at the ends of the pressure chamber.

4. A method according to claim 3 wherein the gap is formed between the billet and a portion of the spacing tube having a smaller inner diameter than the remainder of the spacing tube.

5. Apparatus for generating a holding force to retain a billet and die pressed against a die support in a pressure chamber in a hydrostatic extrusion press, comprising:

a pressure chamber including means for introducing a pressure medium therein;

a die means for supporting a billet;

die support means for supporting said die means and billet;

said billet and the inner surface of said pressure chamber forming a gap therebetween enabling the escape of pressure medium therethrough during the insertion of a billet within said pressure chamber while said pressure chamber is being closed, said gap having a radial dimension of less than 1mm.

6. Apparatus as in claim 5 wherein said pressure chamber includes a spacing tube mounted therein and said gap is formed between said billet and the inner surface of said spacing tube.

7. Apparatus as in claim 6 wherein said spacing tube includes a portion having a smaller diameter than the remainder of said spacing tube and said gap is formed between the smaller diameter portion of said spacing tube and the inner surface of said pressure chamber.

* * * * *